US011698218B2

(12) United States Patent
Osgard

(10) Patent No.: US 11,698,218 B2
(45) Date of Patent: Jul. 11, 2023

(54) REFRIGERATION DOOR SYSTEM AND DOOR ASSEMBLY WITH DEFROSTING AND RELATED METHODS

(71) Applicant: Peter M. Osgard, Jacksonville, FL (US)

(72) Inventor: Peter M. Osgard, Jacksonville, FL (US)

( * ) Notice: Subject to any disclaimer, the term of this patent is extended or adjusted under 35 U.S.C. 154(b) by 0 days.

(21) Appl. No.: 17/554,030

(22) Filed: Dec. 17, 2021

(65) Prior Publication Data

US 2022/0107128 A1 Apr. 7, 2022

Related U.S. Application Data

(63) Continuation of application No. 17/164,930, filed on Feb. 2, 2021, now Pat. No. 11,221,174.

(60) Provisional application No. 62/970,689, filed on Feb. 5, 2020.

(51) Int. Cl.

| | |
|---|---|
| ***F25D 21/08*** | (2006.01) |
| ***F25D 21/12*** | (2006.01) |
| ***F25D 23/02*** | (2006.01) |

(52) U.S. Cl.

CPC ..... *F25D 21/125* (2013.01); *F25D 21/08* (2013.01); *F25D 23/028* (2013.01); *F25D 2317/062* (2013.01)

(58) Field of Classification Search

CPC ..... F25D 23/028

See application file for complete search history.

(56) References Cited

U.S. PATENT DOCUMENTS

| | | | | | |
|---|---|---|---|---|---|
| 3,135,100 | A | | 6/1964 | Taylor et al. | |
| 4,182,130 | A | * | 1/1980 | Ljung | A47F 3/0443 62/82 |
| 4,304,098 | A | * | 12/1981 | Rydahl | F25D 21/125 62/82 |
| 4,337,626 | A | * | 7/1982 | Ibrahim | F25D 21/125 62/82 |
| 4,341,089 | A | * | 7/1982 | Ibrahim | A47F 3/0482 62/236 |
| 4,369,631 | A | * | 1/1983 | Abraham | A47F 3/0408 62/282 |
| 4,379,391 | A | | 4/1983 | Rhee | |
| 4,478,047 | A | * | 10/1984 | Ibrahim | F25D 21/125 62/82 |

(Continued)

*Primary Examiner* — Filip Zec

(74) *Attorney, Agent, or Firm* — Allen, Dyer, Doppelt + Gilchrist, PA

(57) ABSTRACT

A door assembly for a refrigeration door system with a defrosting feature. The door assembly also includes a door frame. The door frame may include a top member having a first end and a second end opposite the first end, and the top member may have a top conduit therein. The door frame may also include a first side member coupled transversely to the first end of the top member and having a first conduit therein, the first conduit being fluidly coupled to the top conduit, and a second side member coupled transversely to the second end of the top member and having a second conduit. The second conduit may be fluidly coupled to the top conduit. The door frame may further have orifices positioned along the top member, the first side member, and the second side member. The door assembly also includes a positive pressure source.

20 Claims, 22 Drawing Sheets

(56) References Cited

U.S. PATENT DOCUMENTS

| | | | | |
|---|---|---|---|---|
| 4,840,040 | A * | 6/1989 | Fung | A47F 3/0447 454/193 |
| 4,855,567 | A | 8/1989 | Mueller | |
| 4,899,554 | A | 2/1990 | Kato et al. | |
| 5,009,080 | A * | 4/1991 | Naganuma | F25D 17/062 454/193 |
| 5,203,175 | A | 4/1993 | Farrey et al. | |
| 5,329,781 | A | 7/1994 | Farrey et al. | |
| 6,155,060 | A | 12/2000 | Parkman | |
| 6,874,331 | B2 | 4/2005 | Chandler et al. | |
| 7,216,396 | B2 | 5/2007 | Slawinski | |
| 7,819,729 | B2 | 10/2010 | Rohrer et al. | |
| 7,954,979 | B2 * | 6/2011 | Sommers | A47F 3/001 362/217.01 |
| 8,117,865 | B2 * | 2/2012 | Allard | H05K 5/0247 62/449 |
| 9,157,675 | B2 * | 10/2015 | Howington | F25D 21/04 |
| 9,429,353 | B2 | 8/2016 | Schumacher et al. | |
| 10,976,096 | B2 | 4/2021 | Seddelmeyer | |
| 2006/0090401 | A1 | 5/2006 | Berry et al. | |
| 2006/0199497 | A1 | 9/2006 | Smith et al. | |
| 2011/0041411 | A1 | 2/2011 | Aragon | |
| 2014/0138052 | A1 | 5/2014 | Hsieh et al. | |
| 2019/0335922 | A1 * | 11/2019 | Artwohl | F25D 27/00 |
| 2019/0338998 | A1 | 11/2019 | Iglesias Ballester | |

* cited by examiner

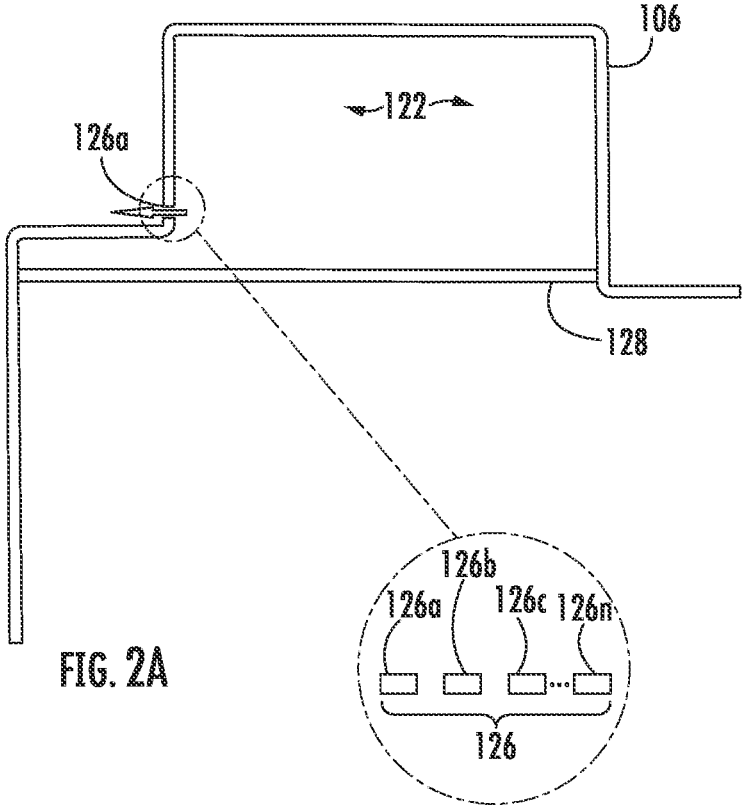
FIG. 2A
FIG. 2B
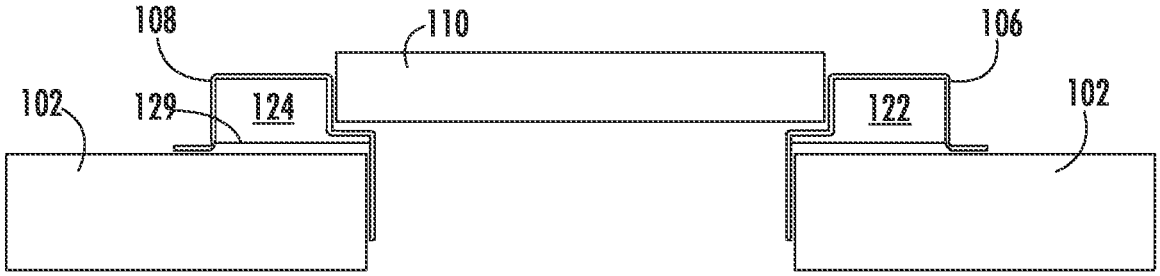
FIG. 2

REFRIGERATION DOOR SYSTEM AND DOOR ASSEMBLY WITH DEFROSTING AND RELATED METHODS

RELATED APPLICATION

This application is a continuation of application Ser. No. 17/164,930 filed Feb. 2, 2021, which is based upon prior filed Application No. 62/970,689 filed Feb. 5, 2020, the entire subject matter of these applications is

TECHNICAL FIELD

The present disclosure relates to the field of walk-in coolers, and, more particularly, to a defrost apparatus for refrigeration doors and related methods.

BACKGROUND

Commercial coolers and freezers today are sufficiently large to accommodate workers inside them. Access is provided by a doorway having a door hingedly mounted in a frame. A persistent problem associated with cooler doors has been their propensity to freeze up. The cold inside surface of the door is moved into the warmer ambient air and causes condensation to form around the frame. Condensed water covers the surface of the frame so that when the door is closed the moisture that has formed on the surface of the frame can freeze and make opening the door difficult. Accordingly, there is a need that has long existed for a walk-in cooler having a door that is substantially less likely to freeze and yet maintains thermal integrity of the walk-in cooler.

SUMMARY

Generally, a refrigeration door system is for a defrosting feature. The refrigeration door system may include a housing defining a refrigerated cavity therein, and a door assembly carried by the housing and providing access to the refrigerated cavity. The door assembly may comprise a door frame and door coupled to the door frame. The door frame may include a top member having a first end and a second end opposite the first end, and the top member may have a top conduit therein. The door frame may also include a first side member coupled transversely to the first end of the top member and having a first conduit therein, the first conduit being fluidly coupled to the top conduit, and a second side member coupled transversely to the second end of the top member and having a second conduit therein. The second conduit may be fluidly coupled to the top conduit. The door frame may further comprise a plurality of orifices positioned along the first side member and the second side member. The door assembly also may include a positive pressure source fluidly coupled to the top conduit and configured to output air into the top conduit and the first and second conduits and through the plurality of orifices, and a heating device configured to heat the air from the positive pressure source.

In particular, the plurality of orifices may have a spacing therebetween. The spacing of the plurality of orifices on the first side member and the second side member may decrease moving away from the top member.

In some embodiments, the first side member and the second side member may each comprise an angled port fluidly coupled to respectively to the first conduit and the second conduit. The angled port may be adjacent a floor. The door assembly may comprise a threshold conduit extending between the first side member and the second side member and under the door. The door assembly may include first and second air diverters fluidly coupled to respectively to proximal ends of the first conduit and the second conduit.

Also, the heating device may comprise first and second heating devices respectively positioned adjacent the first and second ends of the top member. Each heating device may comprise an elongate resistive heating device extending longitudinally in the top member. The positive pressure source may comprise a single positive pressure source, and a third air diverter within the top conduit and to direct air outward towards the first and second ends of the top member.

Another aspect is directed to a door assembly for a refrigeration door system with a defrosting feature. The door assembly also includes a door frame. The door assembly may comprise a door frame and door coupled to the door frame. The door frame may include a top member having a first end and a second end opposite the first end, and the top member may have a top conduit therein. The door frame may also include a first side member coupled transversely to the first end of the top member and having a first conduit therein, the first conduit being fluidly coupled to the top conduit, and a second side member coupled transversely to the second end of the top member and having a second conduit therein. The second conduit may be fluidly coupled to the top conduit. The door frame may further comprise a plurality of orifices positioned along the first side member and the second side member. The door assembly also may include a positive pressure source fluidly coupled to the top conduit and configured to output air into the top conduit and the first and second conduits and through the plurality of orifices, and a heating device configured to heat the air from the positive pressure source.

Another aspect is directed to a method for making a refrigeration door system with a defrosting feature. The method may include coupling a door assembly to be carried by a housing and providing access to a refrigerated cavity. The door assembly may include a top member having a first end and a second end opposite the first end, the top member having a top conduit therein, and a first side member coupled transversely to the first end of the top member and having a first conduit therein, the first conduit being fluidly coupled to the top conduit. The door assembly may include a second side member coupled transversely to the second end of the top member and having a second conduit therein, the second conduit being fluidly coupled to the top conduit, and a plurality of orifices positioned along the first side member and the second side member. The method may include positioning a positive pressure source to be fluidly coupled to the top conduit and configured to output air into the top conduit and the first and second conduits and through the plurality of orifices. The method may comprise coupling a heating device to heat the air from the positive pressure source.

BRIEF DESCRIPTION OF THE DRAWINGS

FIG. 2 is a schematic cross sectional view taken in the direction of line 2-2 of FIG. 1.

FIG. 2A is a detail view of a conduit of the defrost apparatus of FIG. 2.

FIG. 2B is a detail view of a plurality of orifices punched into a first side member and in communication with the conduit of FIG. 2A.

DETAILED DESCRIPTION

Figure 1:
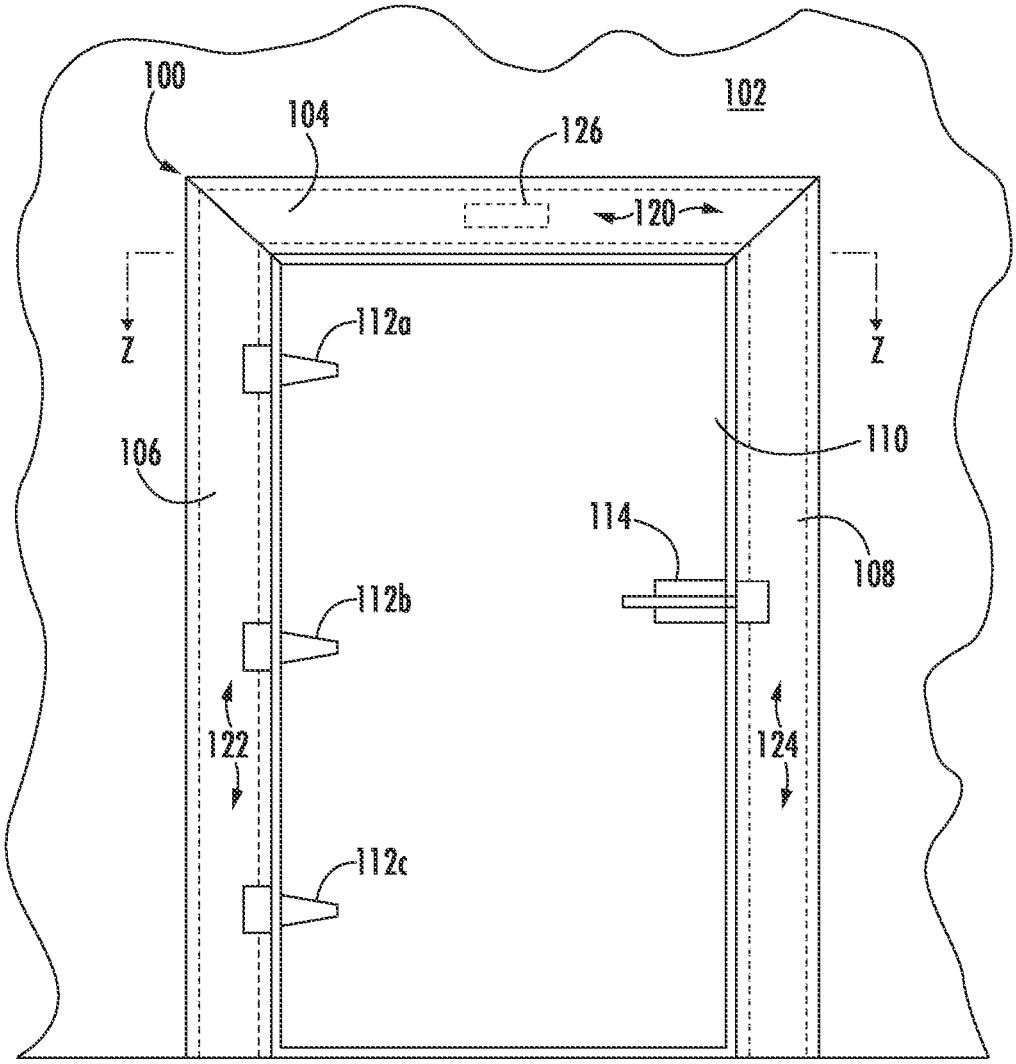
FIG. 1 is a schematic front elevational view of a defrost apparatus for refrigeration doors according to the present invention.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Referring to FIG. 1, a defrost apparatus 100 for a refrigeration door according to the present disclosure is now described. The defrost apparatus 100 is designed for installation in a door opening of a freezer or cooler 102. The door 110 is typically attached to a first side member 106 with hinges 112*a*, 112*b*, 112*c*. A handle 114 is mounted to an opposing side of the hinges 112*a*, 112*b*, 112*c* to open and close the door 110.

The defrost apparatus 100 includes a top member 104 having a first end and a second end and having a top conduit 120 formed therein. The top member 104 also includes a vent opening 126 configured to be coupled to a heated air source.

As described above, the defrost apparatus 100 includes the first side member 106 that has a first end and a second end, where the first end is secured perpendicular to the first end of the top member 104. The first side member 106 also includes a first conduit 122 formed therein coupled to the top conduit 120. A second side member 108 has a first end and a second end, where the second end is secured perpendicular to the second end of the top member 104 and the second side member 108 has a second conduit 124 formed therein coupled to the top conduit 120. The top conduit 120, first conduit 122 and the second conduit 124 are continuous in order for air flow to readily pass through.

Referring now to FIG. 2, a schematic cross sectional view taken in the direction of line 2-2 of FIG. 1 is shown. The first side member 106 is secured between the door 110 and cooler 102. Similarly, the second side member 108 is secured between an opposing edge of the door 110 and the cooler 102. The first and second conduits 122, 124 are also illustrated as being formed by the respective side member 106, 108. As shown in FIG. 2B, a first inner wall 128 is used to form the first conduit 122, with the exterior walls of the first side member 106 forming the remaining boundary for the first conduit 122. The second conduit 124 is formed similarly with a second inner wall 129 and the exterior walls of the second side member 108.

In addition, the first side member 106 also includes a plurality of orifices 126*a*, 126*b*, 126*c*-126*n* in an exterior wall. The plurality of orifices 126*a*, 126*b*, 126*c*-126*n* are configured to blow heated air out from the respective top, first and second conduits 120, 122, 124.

Figure 3:
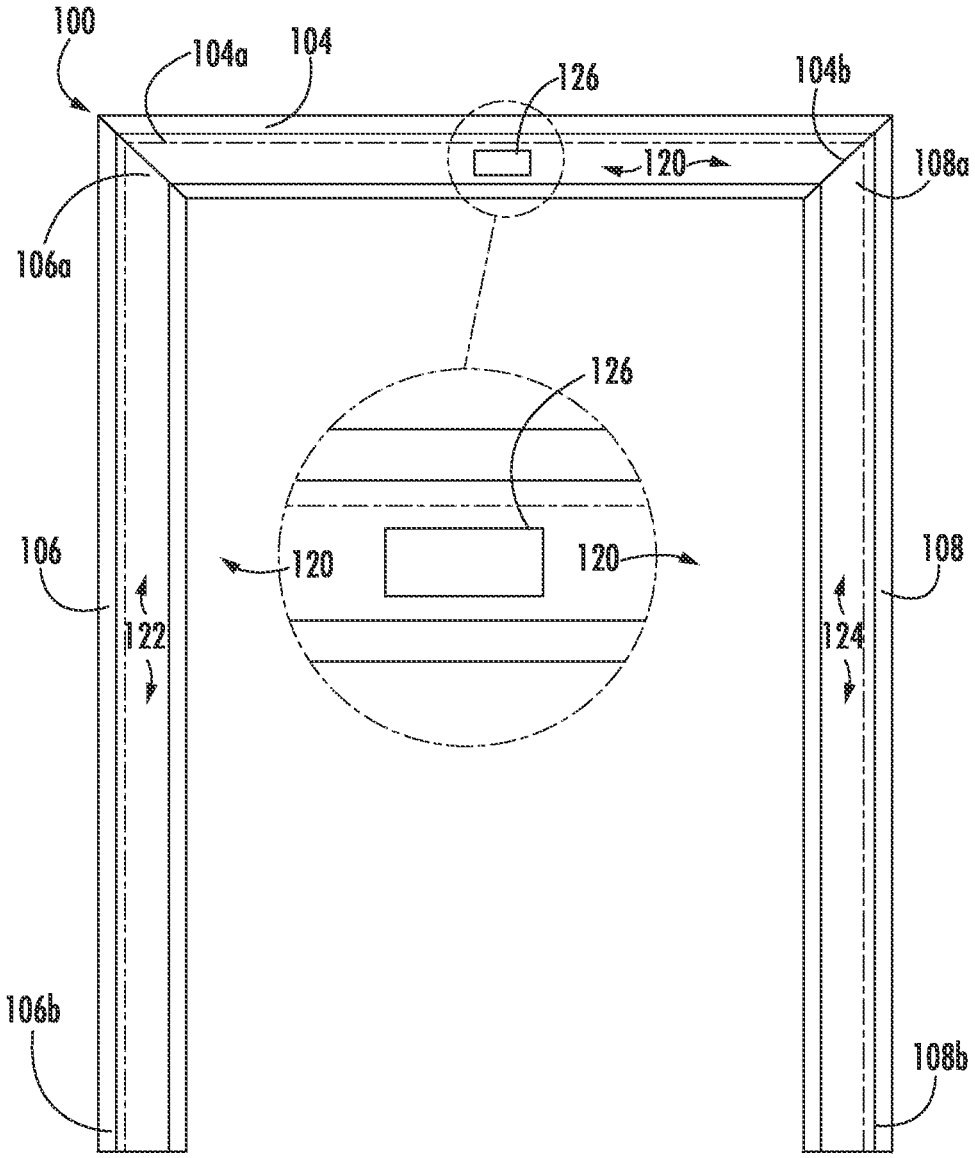
FIG. 3 is a schematic front elevational view of a top member, a first side member and a second side member of the defrost apparatus forming a door frame for a refrigeration door to be mounted.

A schematic of the defrost apparatus 100 is illustrated in FIG. 3 without showing the relationship of the cooler 102 and door 110 for clarity. As described above, the defrost apparatus 100 includes the top member 104 that has a first end 104*a* and an opposing second end 104*b*, and the top conduit 120. A first end 106*a* of the first side member 106 is secured perpendicular to the first end 104*a* of the top member 104. The second side member 108 has a first end 108*a* and a second end 108*b*, where the first end 108*a* is secured perpendicular to the second end 104*b* of the top member 104. The vent opening 126 is also formed in the top conduit 104 although the vent opening 126 could also be positioned within the first or second side members 106, 108. There could also be more than one vent opening 126. The vent opening 126 is coupled to a heated air source in order to provide heated air through the respective conduits 120, 122, 124 and out of the plurality of orifices 126.

Figure 4:
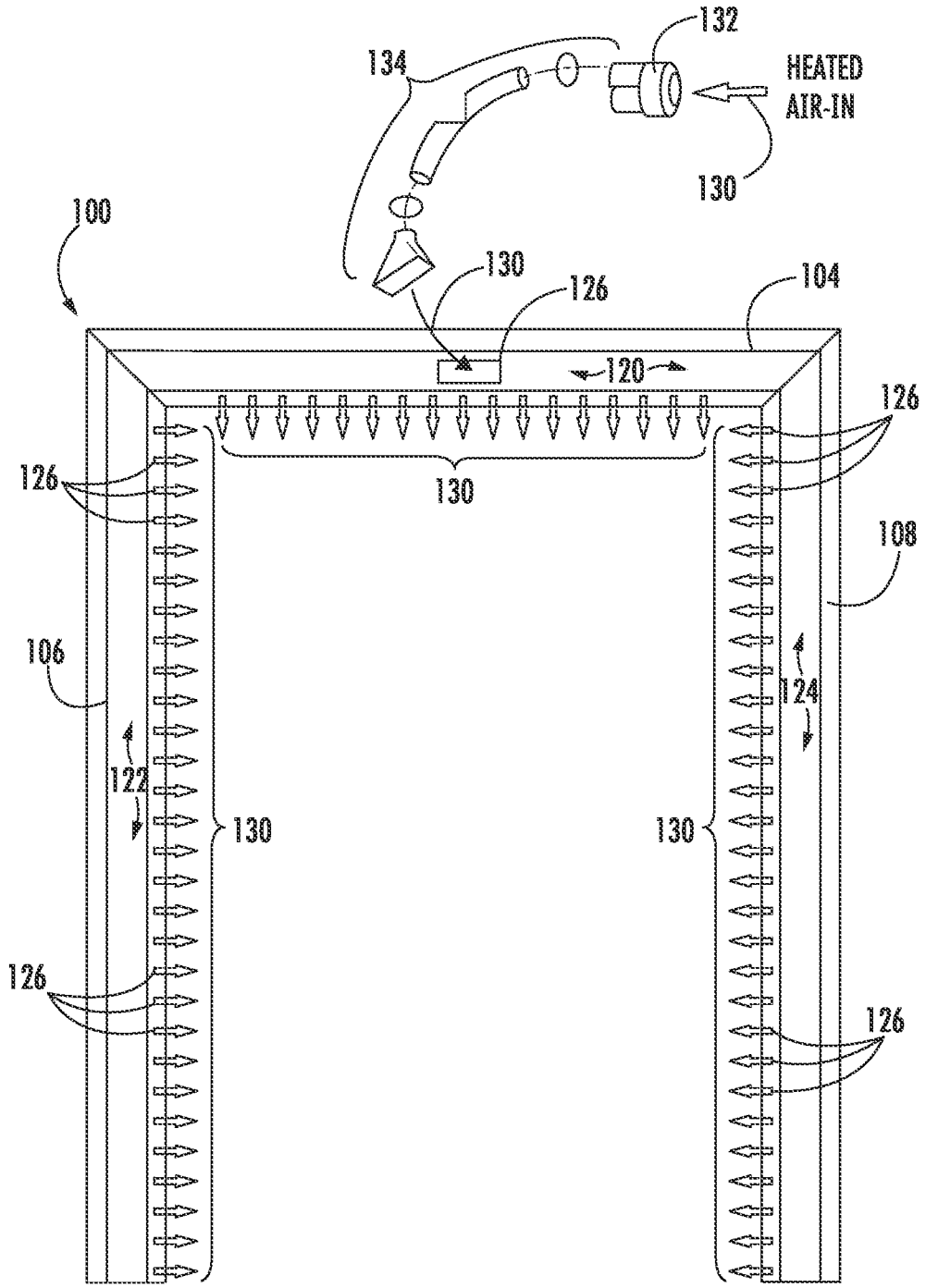
FIG. 4 is a schematic of the door frame of FIG. 3 illustrating operation of the defrost apparatus.

FIG. 4 is a schematic illustrating operation of the defrost apparatus 100. A blower 132 is coupled to a supply conduit 134. The blower 132 is configured to provide heated air 130 through the supply conduit to the vent 126 formed in the top member 104. The vent 126 is in communication with the top conduit 104. As the heated air 130 is provided within the top conduit 120, the heated air 130 flows down to each of the first and second side members 106, 108. As the pressure increases within the respective conduits 120, 122, 124, the heated air 130 is forced out through the plurality of orifices 126. The plurality of orifices 126 are configured to direct the heated air 130 to between edges of the refrigeration door 110 and the top member 104 and the first and second side members 106, 108 (collectively, the door frame) in order to melt and prevent ice from forming. It will of course be appreciated by those skilled in the art that if it is desired to heat the bottom of the door 110 to further reduce the likelihood that the door 110 will be stuck because of freezing, then a conduit having additional orifices can be extended from the first and/or second conduit 122, 124 across the threshold to deliver heated air.

Figure 5:
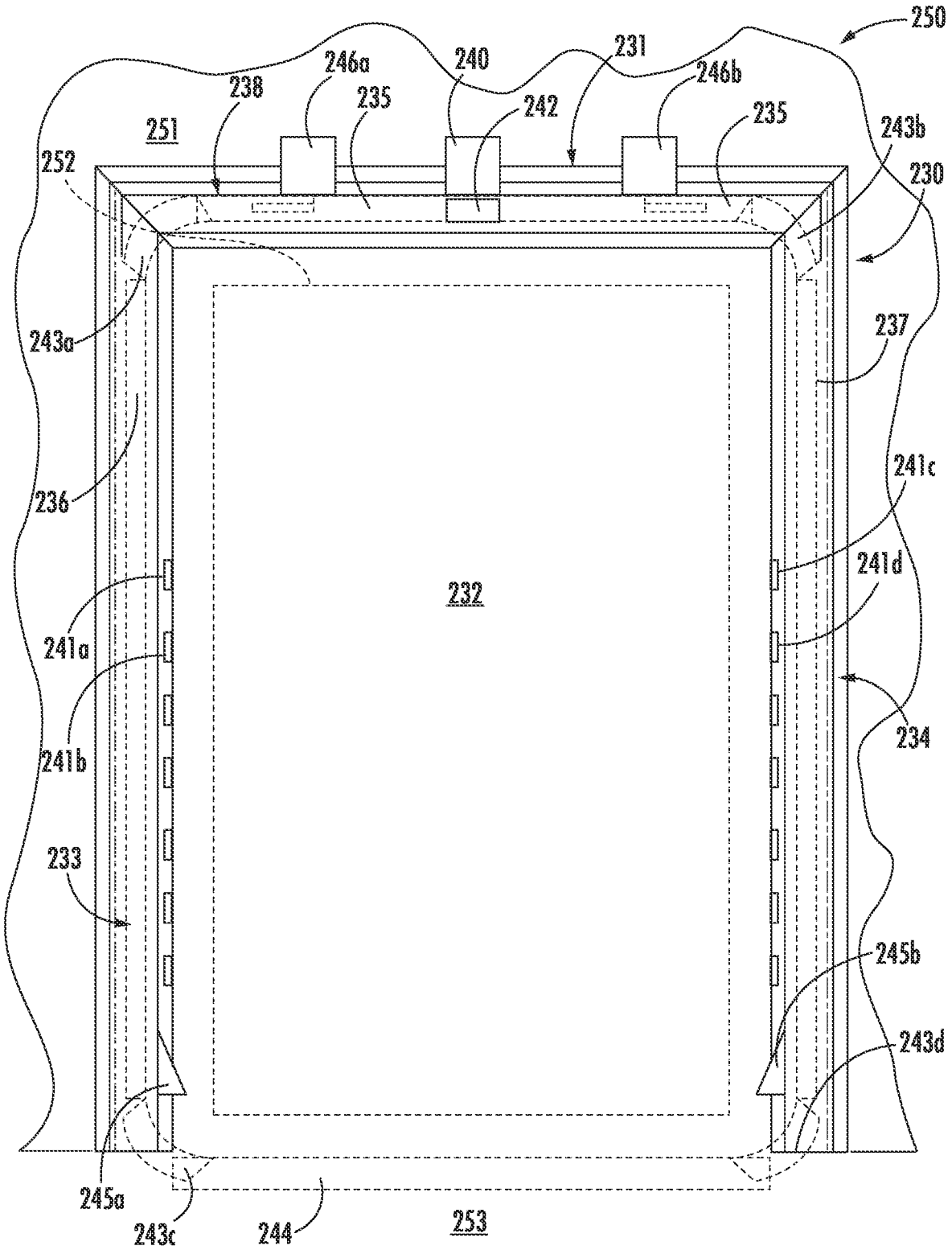
FIG. 5 is a schematic diagram of a first embodiment of a door assembly, according to the present disclosure.
Figure 6A:
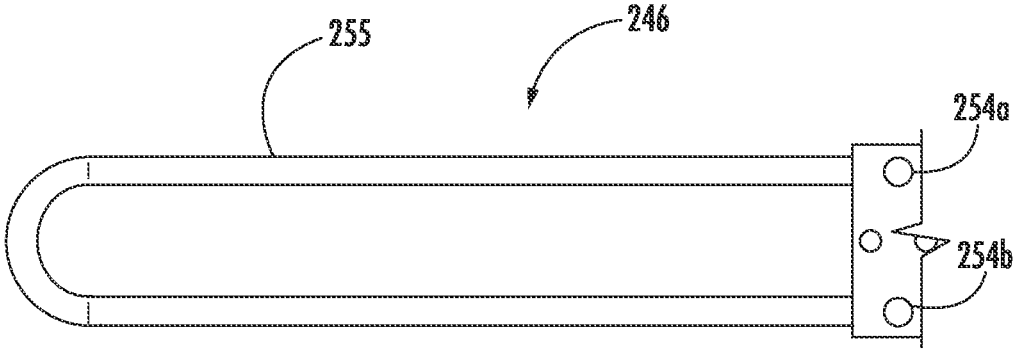
FIGS. 6A-6B are schematic top plan and schematic side views respectively of a resistive heater from the door assembly of FIG. 5.
Figure 6B:
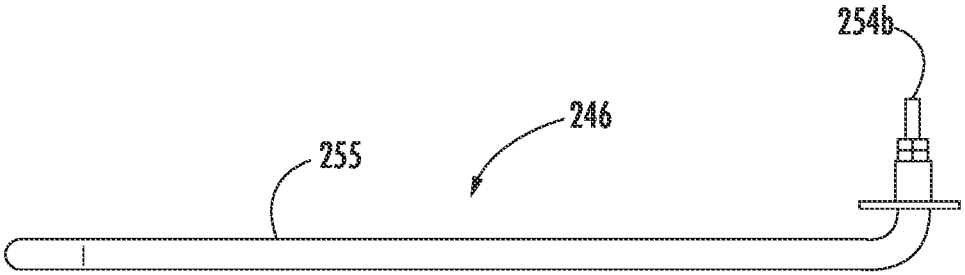

Referring now to FIGS. 5 & 6A-6B, a refrigeration door system 250 is now described. The refrigeration door system is equipped with a defrosting feature. The refrigeration door system includes a housing 251 defining a refrigerated cavity 252 therein, and a door assembly 230 carried by the housing and providing an access to the refrigerated cavity. The door assembly 230 illustratively includes a door frame 231, and a door 232 coupled to the door frame and configured to switch between a first position closing the access and a second position opening the access.

The door frame 231 illustratively comprises a top member 238, a first side member 233, and a second side member 234. Each of the top member 238, and the first and second side members 233-234 has a first end and a second end.

The top member 238 has a top conduit 235 therein. The first end of the first side member 233 is coupled transversely to the first end of the top member 238. The first side member 233 illustratively includes a first conduit 236 therein and is fluidly coupled to the top conduit 235.

The first end of the second side member 234 is coupled transversely to the second end of the top member 238. The second side member 234 illustratively comprises a second conduit 237 therein and is fluidly coupled to the top conduit 235.

The door assembly 230 illustratively comprises a positive pressure source 240 (e.g. a powered fan or impeller) fluidly coupled to the top conduit 235 and configured to blow heated air into the top conduit and to the first and second conduits 236-237, and a plurality of orifices 241*a*-241*d* positioned along lower portions of the first side member 233, and the second side member 234 configured to exit the heated air out therefrom.

The door assembly 230 illustratively comprises an air diverter 242 fluidly coupled to an output of the positive pressure source 240 and configured to route pressurized air down opposite ends of the top conduit 235. The first end of the top conduit 235 illustratively comprises a first corner deflector 243*a*, and the second end of the top conduit 235 illustratively comprises a second corner deflector 243*b*.

The door assembly 230 illustratively comprises a threshold conduit 244 extending between the second ends of the first and second side members 233-234. Also, the second ends of the first and second side members 233-234 illustratively comprise third and fourth corner deflectors 243*c*-243*d*, which are fluidly coupled to the threshold conduit 244. In some embodiments, the third and fourth corner deflectors 243*c*-243*d* and the threshold conduit 244 may be omitted.

The door assembly 230 illustratively comprises a first downward exhaust vent 245*a* coupled to the first conduit 236, and a second downward exhaust vent 245*b* coupled to the second conduit 237. It should be appreciated that the first downward exhaust vent 245*a* and the second downward exhaust vent 245*a* in conjunction with the threshold conduit 244 are configured to prevent frost buildup on the threshold of the door 232.

The door assembly 230 illustratively comprises first and second heaters 246*a*-246*b* flanking the air diverter 242 and for heating the output of the output of the positive pressure source 240. In some embodiments, for example, as depicted in FIG. 6, the first and second heaters 246*a*-246*b* each comprises a resistive heating element extending longitudinally and respectively within opposite ends of the top conduit 235. In particular, each of the first and second heaters 246*a*-246*b* comprises an L-shaped resistive heater configured to extend within the top conduit 235.

Referring again to FIGS. 5 & 6A-6B, a refrigeration door system 250 according to the present disclosure is now described. The refrigeration door system 250 illustratively includes a housing 251 defining a refrigerated cavity 252 therein, and a door assembly 230 carried by the housing and providing access to the refrigerated cavity. The refrigeration door system 250 has a defrosting feature for preventing ice and frost buildup around the frame of the door assembly 230. Advantageously, the prevention of frost build-up enhances safety.

The door assembly 230 comprises a door frame 231 and door 232 coupled to the door frame. The door frame 231 includes a top member 238 having a first end and a second end opposite the first end. The top member 238 has a top conduit 235 therein. The door frame 231 also includes a first side member 233 coupled transversely to the first end of the top member 238 and having a first conduit 236 therein. The first conduit 236 is fluidly coupled to the top conduit 235.

The door frame 231 also includes a second side member 234 coupled transversely to the second end of the top member 238 and having a second conduit 237 therein. The second conduit 237 is fluidly coupled to the top conduit 235. In other words, the top conduit 235, the first conduit 236, and the second conduit 237 are all fluidly coupled. The door frame 231 illustratively comprises a plurality of orifices 241*a*-241*d* positioned along the first side member 233 and the second side member 234. In some embodiments, the plurality of orifices 241*a*-241*d* may extend along the entire length of the first side member 233 and the second side member 234. Moreover, in some embodiments, the plurality of orifices 241*a*-241*d* may extend along partially or entirely the length of the top member 238. It should be appreciated that when the door 232 is in the closed position, the plurality of orifices 241*a*-241*d* are positioning at the peripheral flange of the door.

The door assembly 230 also includes a positive pressure source 240 (e.g. a motorized blower/fan) fluidly coupled to the top conduit 235 and configured to output air into the top conduit and the first and second conduits 236, 237 and through the plurality of orifices 241*a*-241*d*. The positive pressure source 240 may comprise a single positive pressure source, and a third air diverter 242 within the top conduit 235 and to direct air outward towards the first and second ends of the top member 238 and down the first and second conduits 236, 237.

The door assembly 230 also includes a heating device configured to heat the air from the positive pressure source 240. More specifically, the heating device illustratively includes first and second heating devices 246*a*-246*d* respectively positioned adjacent the first and second ends of the top member 238. As perhaps best seen in FIGS. 6A-6B, each heating device 246*a*-246*d* comprises a pair of electrical connection terminals 254*a*-254*b*, and an elongate resistive heating element 255 coupled to the pair of electrical connection terminals and extending longitudinally in the top member 238.

The first side member 233 and the second side member 234 each comprises an angled port 245*a*-245*b* fluidly coupled to respectively to the first conduit 236 and the second conduit 237. The angled port 245*a*-245*b* is adjacent a floor 253. The door assembly 230 comprises a threshold conduit 244 extending between the first side member 233 and the second side member 234 and under the door 232. The door assembly 230 illustratively includes first and second air diverters 243*a*-243*b* fluidly coupled to respectively to proximal ends of the first conduit 236 and the second conduit 237. The door assembly 230 illustratively includes third and fourth air diverters 243*c*-243*d* fluidly coupled to respectively to distal ends of the first conduit 236 and the second conduit 237.

The first and second air diverters 243*a*-243*b* are configured to reduce air flow resistance in the transition turn from the top conduit 235 to the first and second conduits 236, 237, respectively. The third and fourth air diverters 243*c*-243*d* are configured to reduce air flow resistance in the transition turn from the first and second conduits 236, 237, respectively, to the threshold conduit 244. In some embodiments, each diverter 243*a*-243*d* may each comprise a plate angled at 45° (±10°) with respect to the longitudinal axis of the top member 238, but may alternatively comprise tubular turn connectors (i.e. a hollow tube shaped in a right angle).

Another aspect is directed to a method for making a refrigeration door system 250 with a defrosting feature. The method includes coupling a door assembly 230 to be carried by a housing 251 and providing access to a refrigerated cavity 252. The door assembly 230 includes a top member 238 having a first end and a second end opposite the first end, the top member having a top conduit 235 therein, and a first side member 233 coupled transversely to the first end of the top member and having a first conduit 236 therein, the first conduit being fluidly coupled to the top conduit. The door assembly 230 includes a second side member 234 coupled transversely to the second end of the top member 238 and having a second conduit 237 therein, the second conduit being fluidly coupled to the top conduit, and a plurality of orifices 241*a*-241*d* positioned along the first side member 233 and the second side member 234. The method includes positioning a positive pressure source 240 to be fluidly coupled to the top conduit 235 and configured to output air into the top conduit and the first and second conduits 236, 237 and through the plurality of orifices 241*a*-241*d*. The method comprises coupling a heating device to heat the air from the positive pressure source 240.

Referring now additionally to FIGS. 7-12, another embodiment of the door assembly 330 is now described. In this embodiment of the door assembly 330, those elements already discussed above with respect to FIGS. 5 & 6A-6B are incremented by 100 and most require no further discussion herein. This embodiment differs from the previous embodiment in that this door assembly 330 illustratively omits the threshold conduit 244 of FIG. 5.

Figure 7:
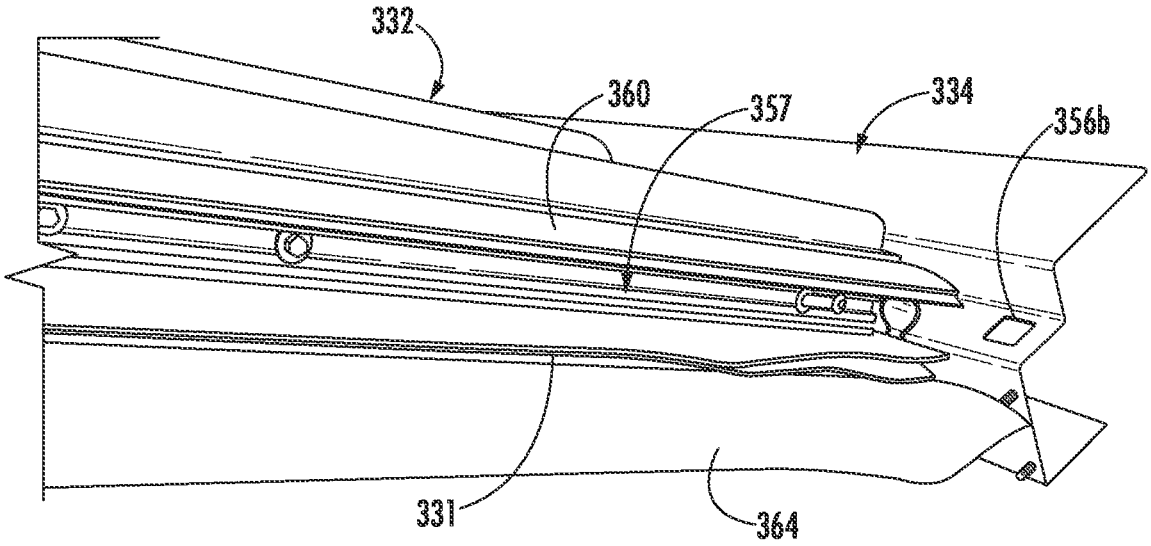
FIG. 7 is a schematic bottom view of a second embodiment of the door assembly, according to the present disclosure.
Figure 8:
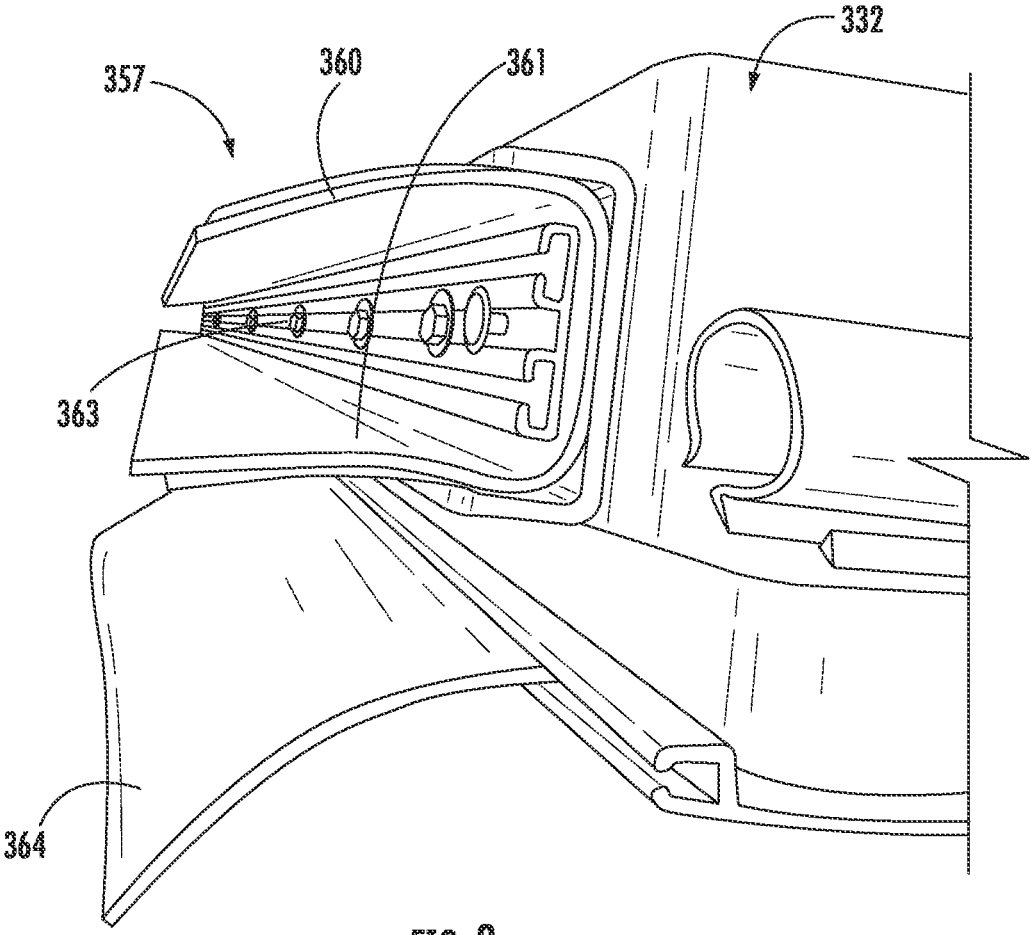
FIG. 8 is a schematic side view of a door from the second embodiment of the door assembly of FIG. 7.
Figure 9:
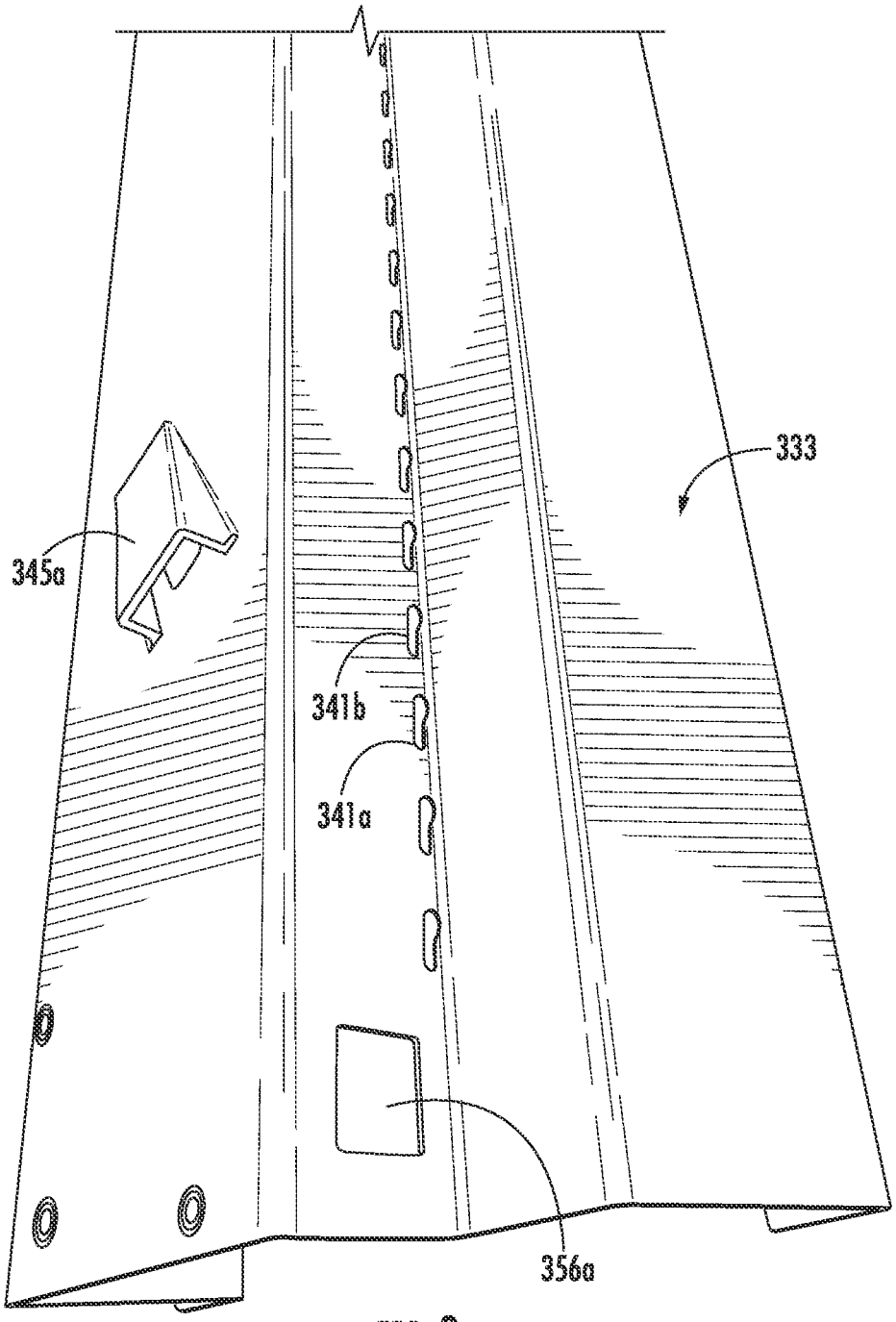
FIG. 9 is a schematic perspective view of a first member from the second embodiment of the door assembly of FIG. 7.

In FIGS. 7-9, the bottommost portion of the door 332 illustratively includes a door sweep 357 comprising first and second molding sweeps 360, 361, which define a longitudinal channel 363 between opposing ends of the door. The door sweep 357 also comprises a third molding 364 spaced apart from the first and second molding sweeps 360, 361. As can be seen, the first side member 333 includes a first output port 356*a* fluidly coupled to the first conduit 336, and the second side member 334 includes a second output port 356*b* fluidly coupled to the second conduit 337. When the door 332 is in a closed position, the first and second output ports 356*a*-356*b* are aligned with the longitudinal channel 363. Therefore, heat air will flow through the longitudinal channel 363 and prevent ice buildup on the threshold. The longitudinal channel 363 feature may be in addition to or in alternative (as depicted) to the above noted threshold conduit 344.

Figure 10:
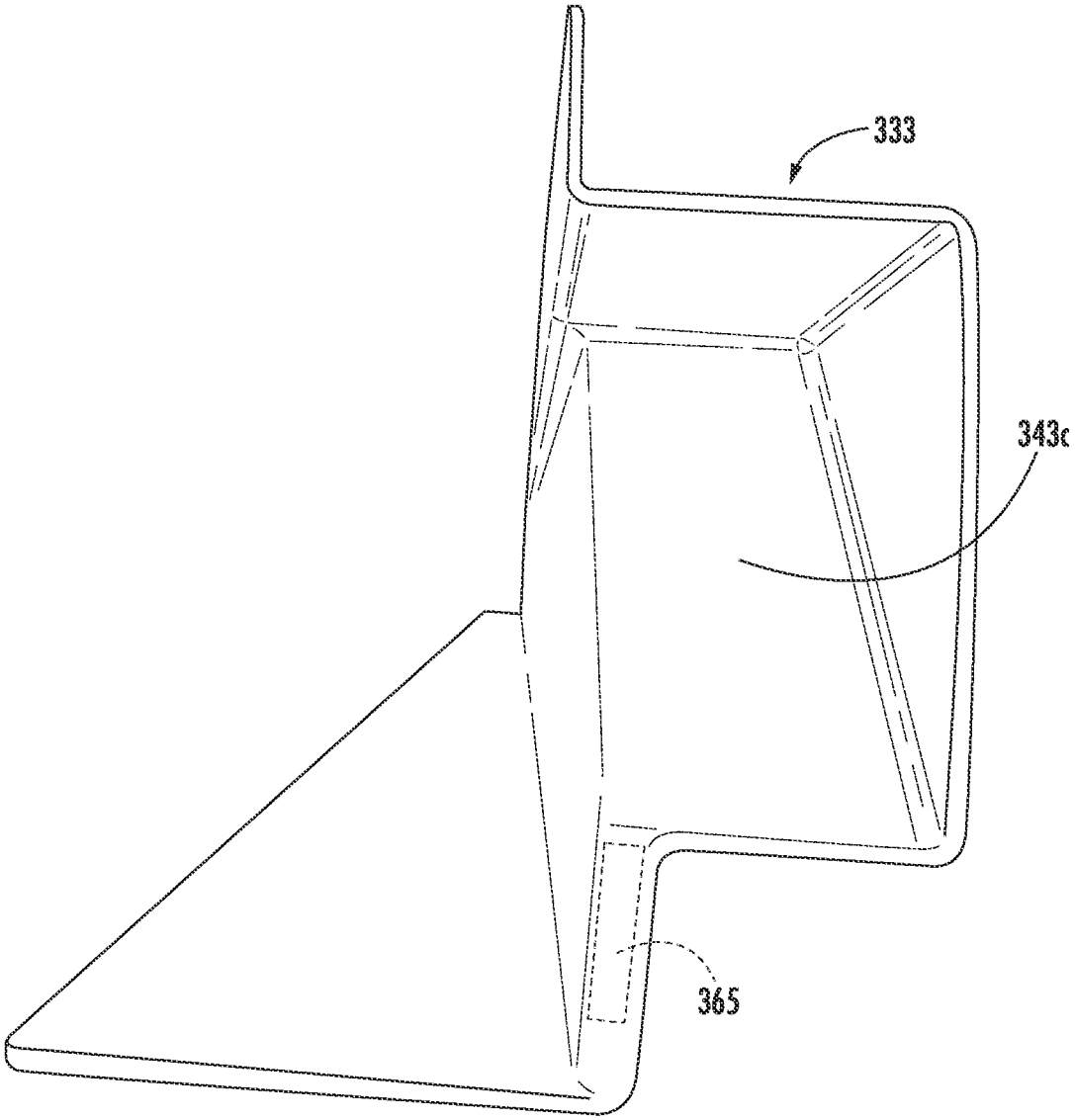
FIG. 10 is a schematic bottom view of the first member from the second embodiment of the door assembly of FIG. 7.
Figure 11:
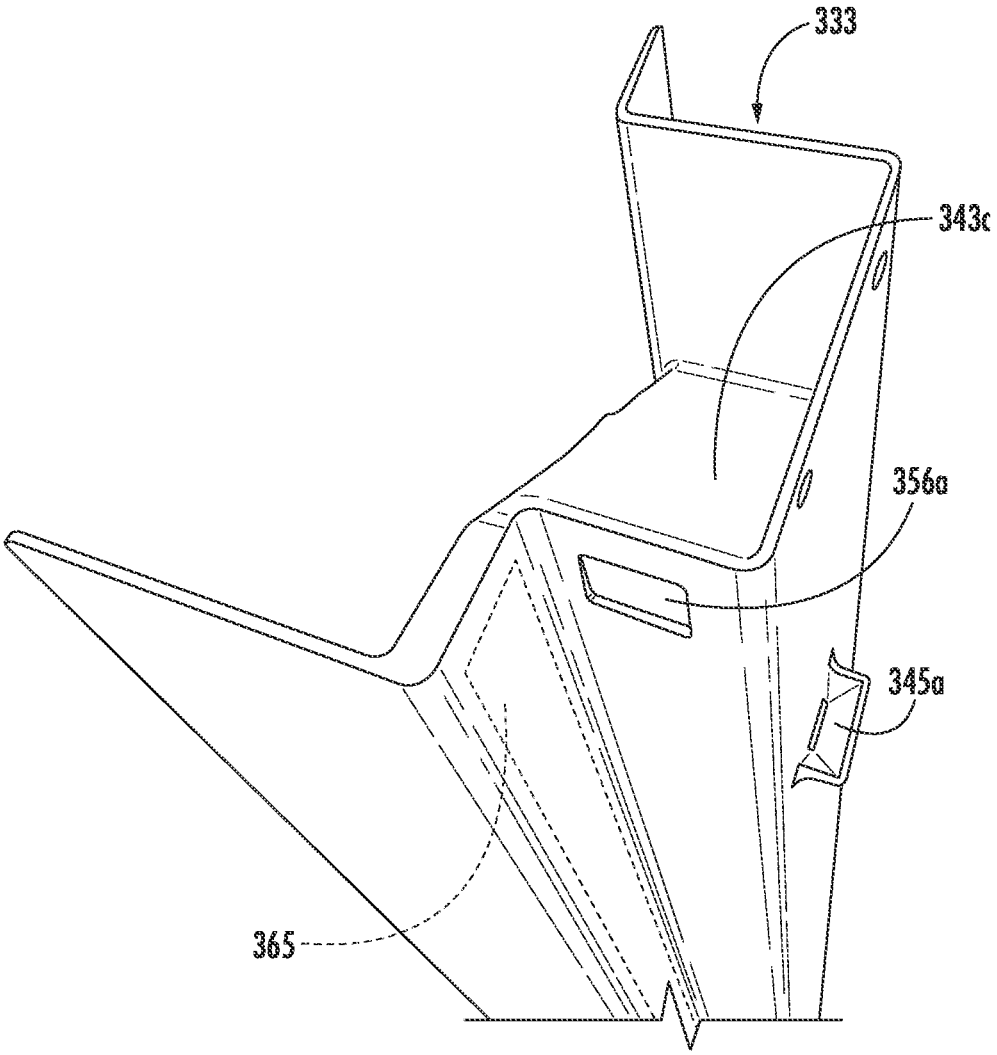
FIG. 11 is a schematic bottom perspective view of the first member from the second embodiment of the door assembly of FIG. 7.

In FIG. 10-11, the second end/bottommost portions of the first side member 333 is shown, which shows the third air diverter 343*c*. As perhaps best seen in FIGS. 10-11, the door frame portion adjacent an inner most edge defines a thin cavity 365 extending along the length of the first side member 333 and being fluidly coupled to the first conduit 336. Helpfully, this prevents frost build-up on door frame.

Figure 12:
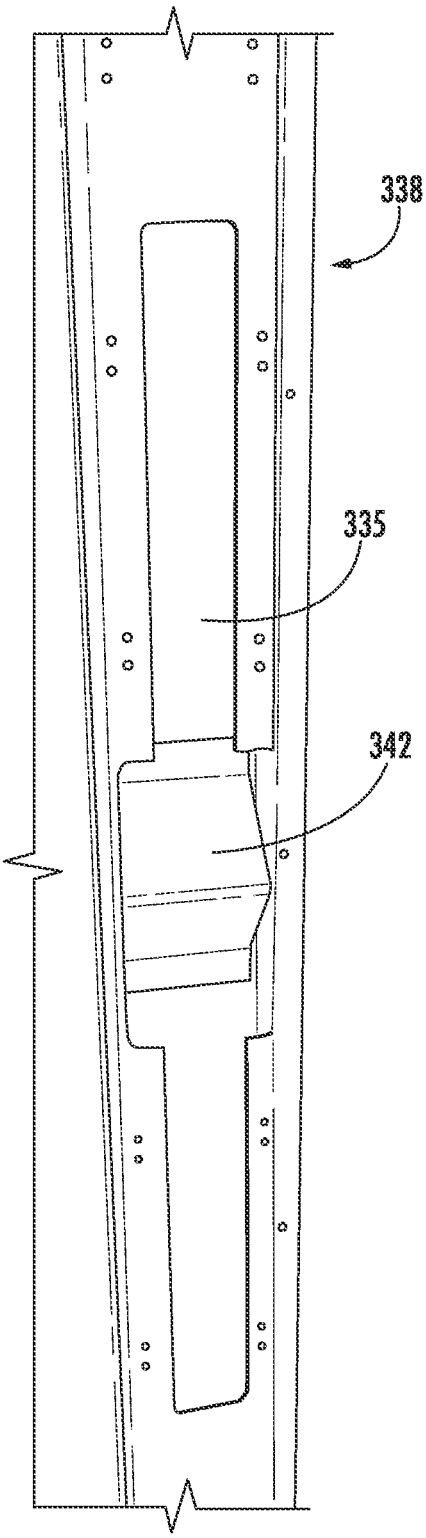
FIG. 12 is a schematic perspective view of a top member from the second embodiment of the door assembly of FIG. 7.

In FIG. 12, the top member 338 is shown with the first and second heaters removed. Helpfully, this embodiment is readily serviced, permitting easy replacement of the first and second heaters, and cleaning of the air diverter 342.

Figure 13:
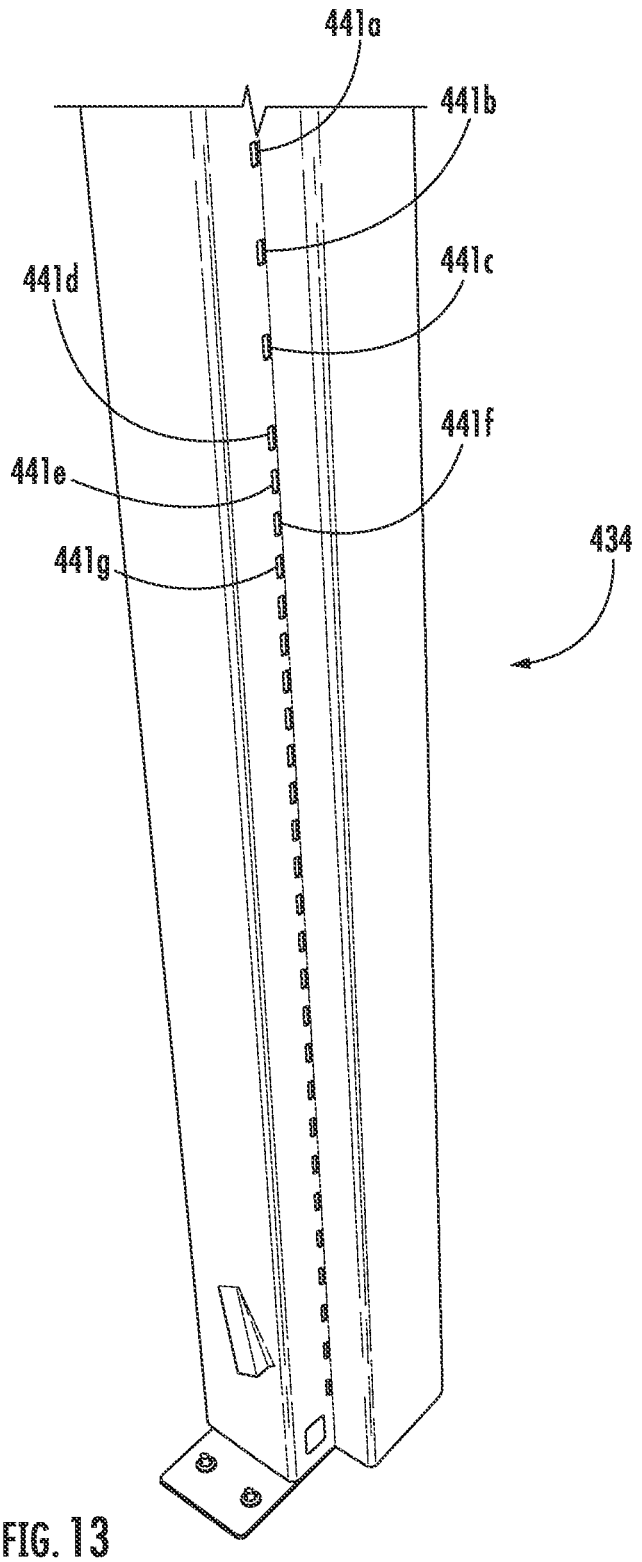
FIG. 13 is a schematic perspective view of a third embodiment of the door assembly, according to the present disclosure.
Figure 14:
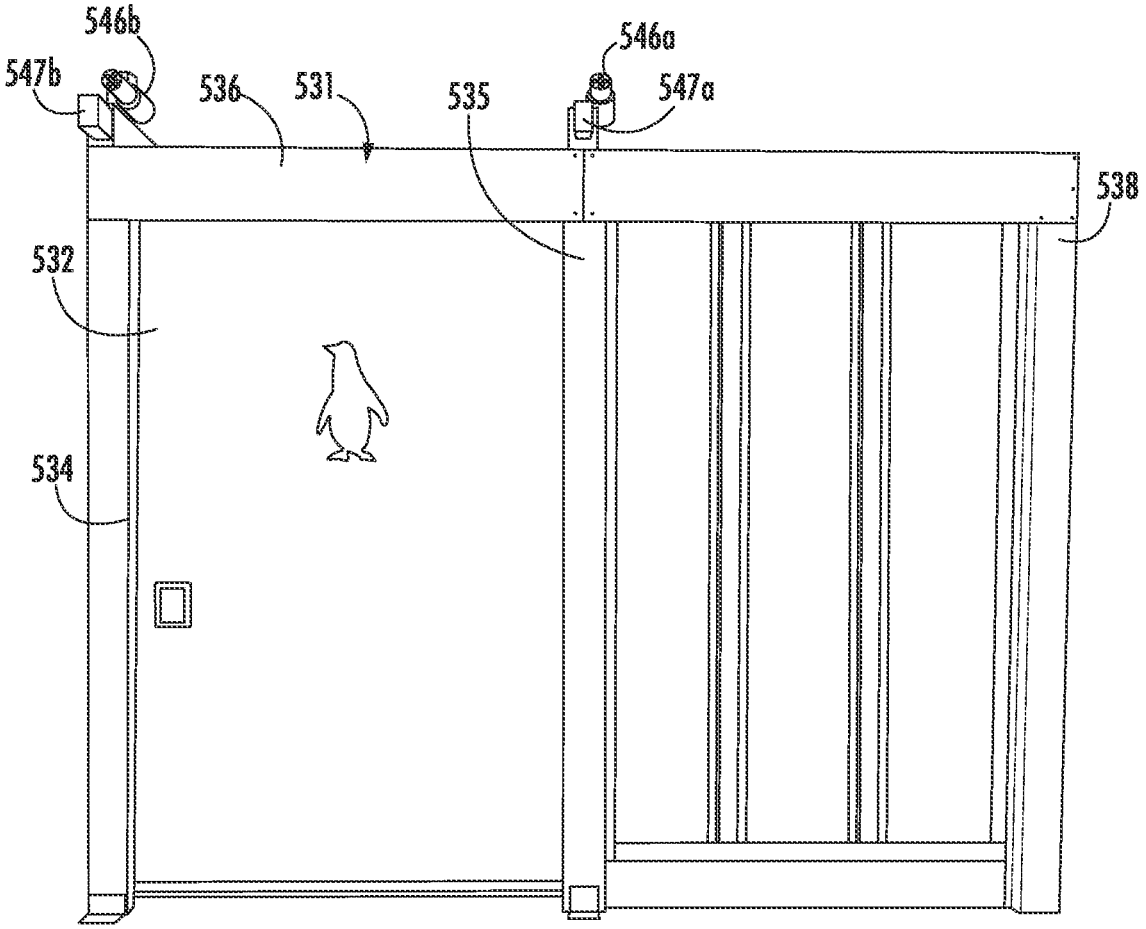
FIG. 14 is a schematic perspective view of a fourth embodiment of the door assembly, according to the present disclosure.

Referring now additionally to FIG. 13, another embodiment of the door assembly 430 is now described. In this embodiment of the door assembly 430, those elements already discussed above with respect to FIGS. 5 & 6A-6B are incremented by 200 and most require no further discussion herein. This embodiment differs from the previous embodiment in that this door assembly 430 illustratively has the plurality of orifices 441*a*-441*g* with a spacing therebetween. Here, the spacing of the plurality of orifices 441*a*-441*g* on the first side member and the second side member may decrease moving away from the top member. This same spacing pattern may be repeated on the second side member (not shown). As will be appreciated, this feature enhances system air flow resistance.

Referring now additionally to FIGS. 14-22, a sliding door embodiment of the door assembly 530 is now described. The sliding door assembly 530 comprises a door frame 531, and a sliding door 532 slidingly carried by the door frame and switching between open and closed positions. As perhaps best seen in FIG. 15, the sliding door assembly 530 comprises an upper track 533 coupled to the door frame 531 and for slidingly carrying the door 532.

The door frame 531 illustratively comprises first and second members 534, 538, a medial member 535 extending substantially parallel (i.e. ±10° of parallel) to and between the first and second members, and a top member 536 extending between the first and second members and being coupled to the medial member. The door assembly 530 further comprises a proximal molding section 537 carried by a proximal end of the sliding door 532, and a distal molding section 540 carried by the first member 534. When the sliding door 532 is in the closed position, the proximal molding section 537 is aligned with the medial member 535, and the distal molding section 540 is aligned with a distal edge of the sliding door. The door assembly 530 further comprises an upper molding section 541 carried by the top member 536.

Figure 15:
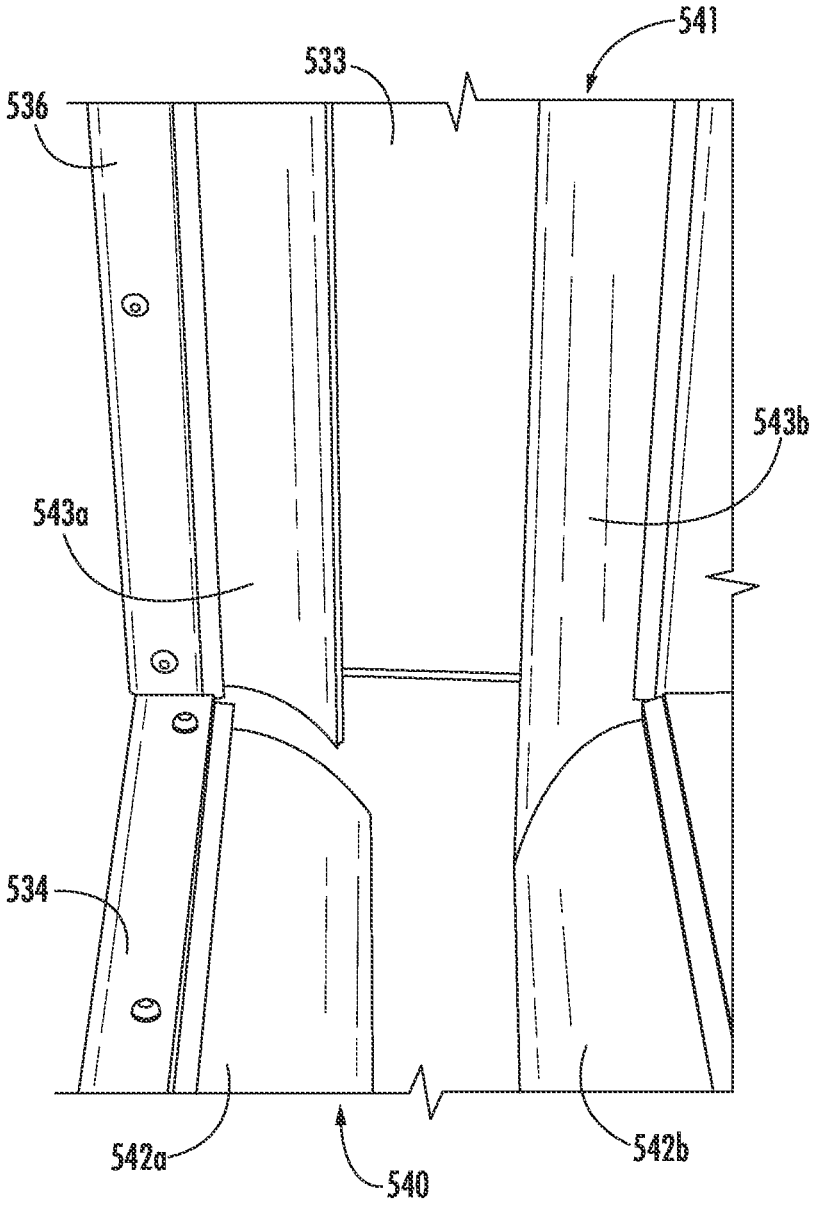
FIG. 15 is a schematic perspective view of a top member from the fourth embodiment of the door assembly of FIG. 14.
Figure 16:
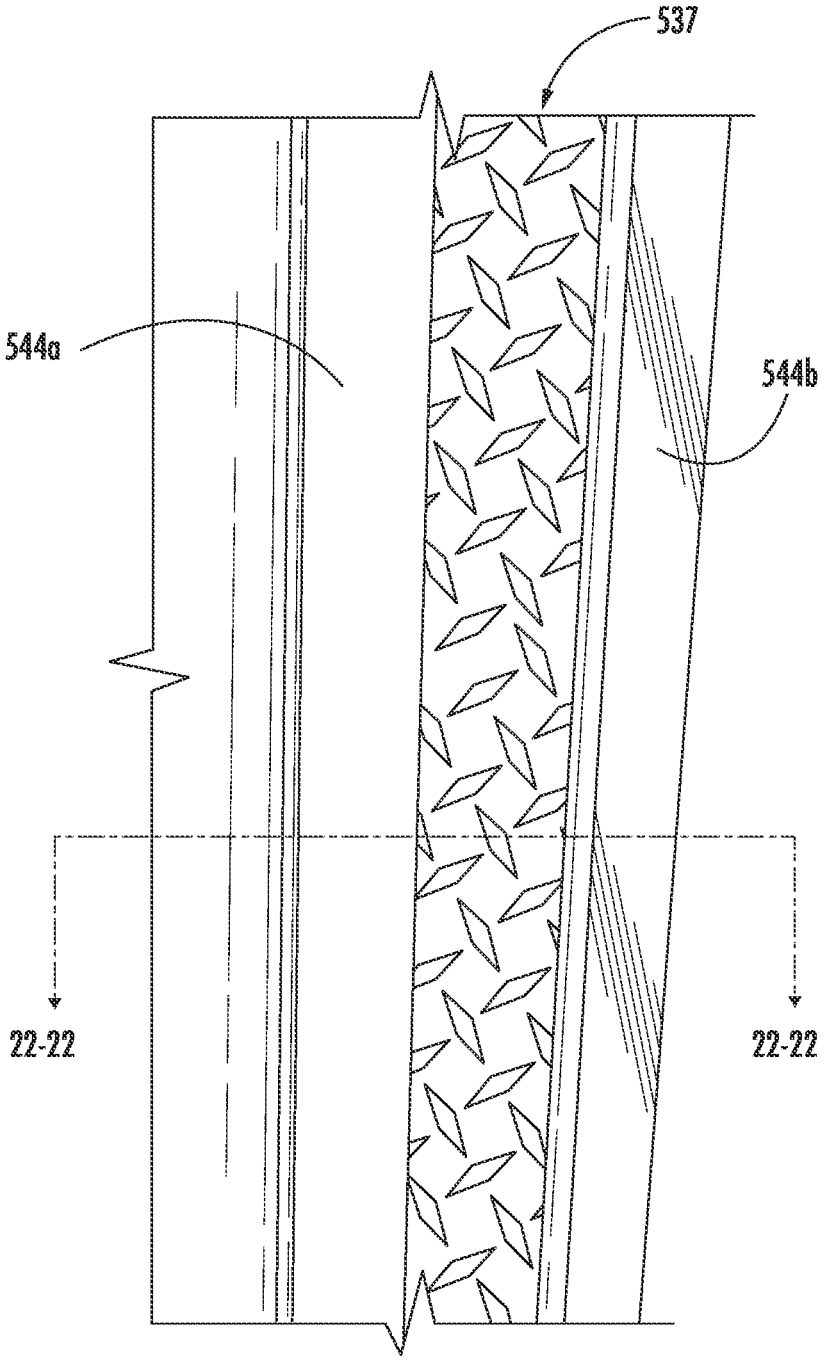
FIG. 16 is a schematic perspective view of a proximal molding section from the fourth embodiment of the door assembly of FIG. 14.
Figure 17:
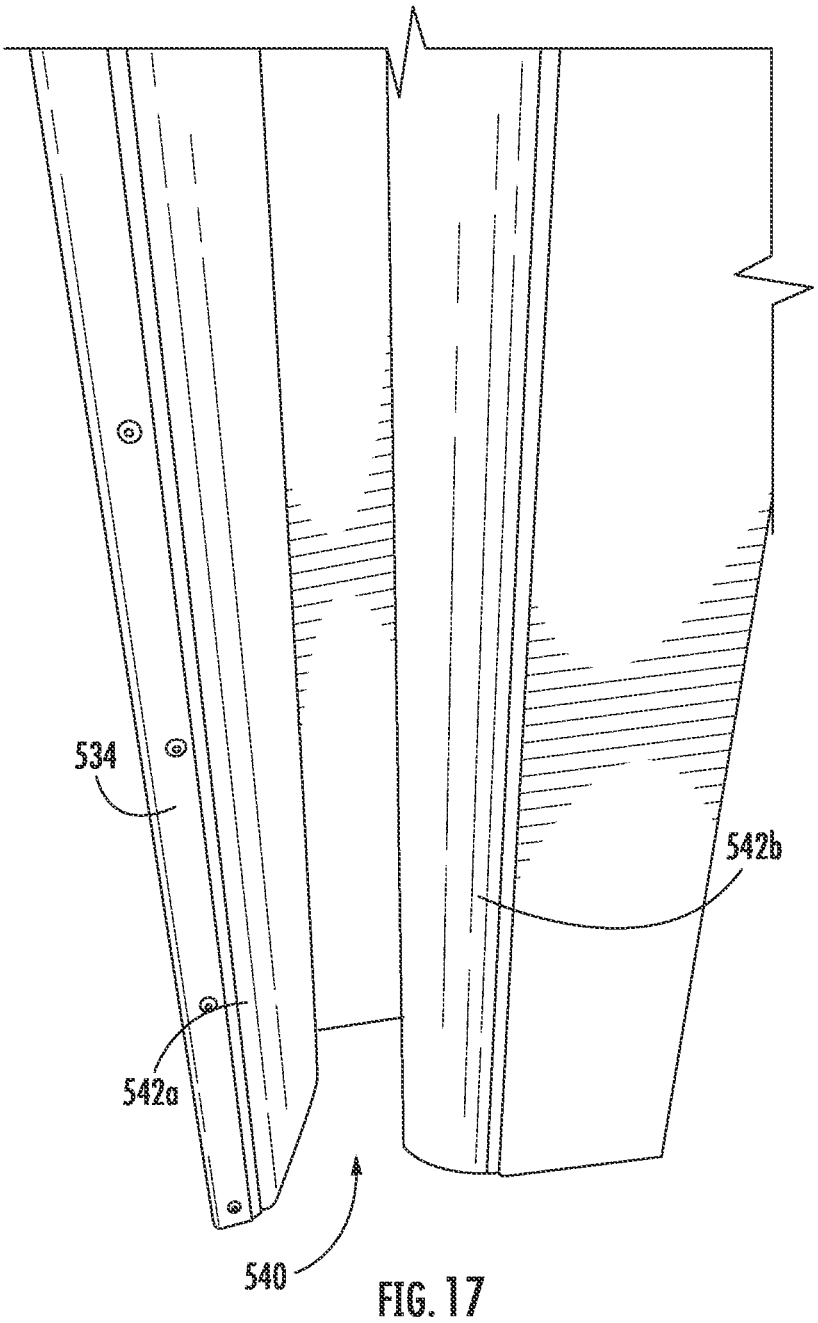
FIG. 17 is a schematic perspective view of a distal molding section from the fourth embodiment of the door assembly of FIG. 14.
Figure 18:
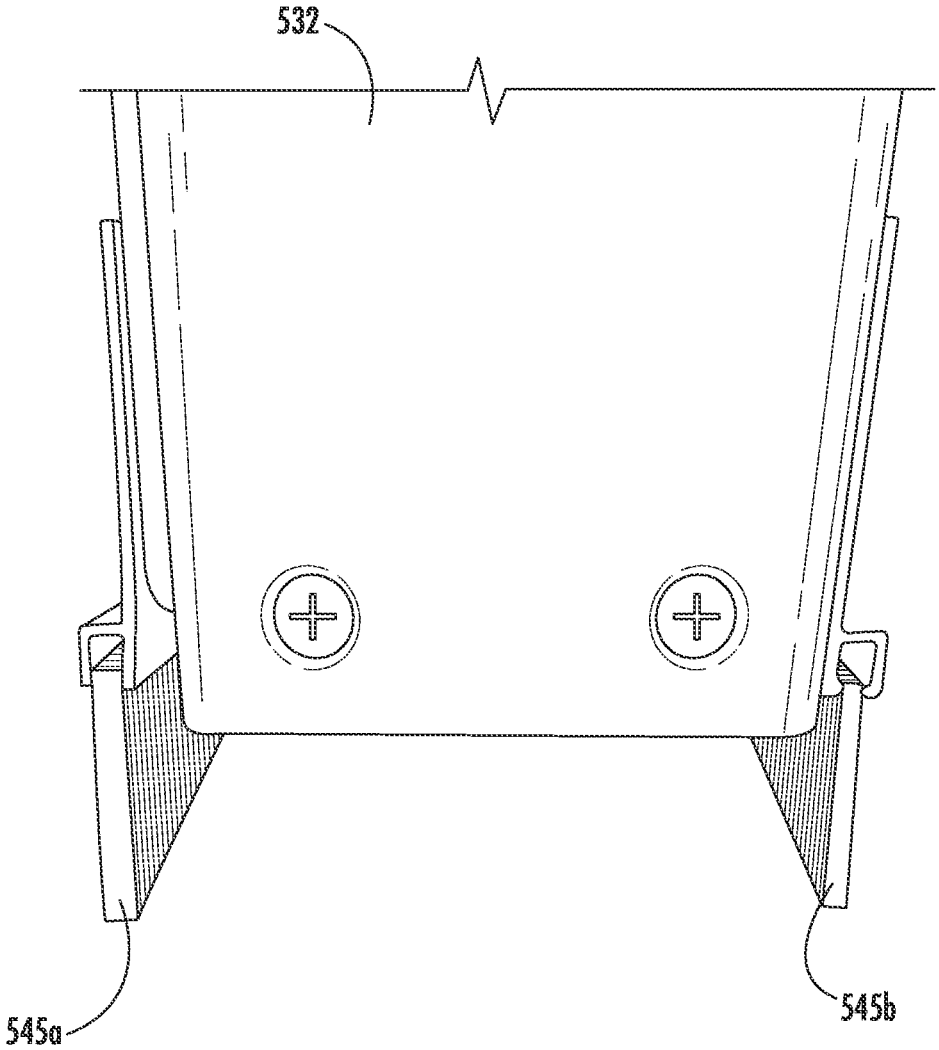
FIG. 18 is a schematic side view of a door sweep from the fourth embodiment of the door assembly of FIG. 14.

As perhaps best seen in FIG. 15, the distal molding section 540 illustratively includes first and second distal molding sweep strips 542*a*-542*b*, and the upper molding section 541 also comprises first and second distal molding sweep strips 543*a*-543*b*. The distal molding section 540 comprises a U-shaped molding channel extending vertically, and the upper molding section 541 comprises a U-shaped molding channel extending laterally. When the sliding door 532 is closed, the distal molding section 540 defines a first conduit, and the upper molding section 541 defines a top conduit.

Figure 22:
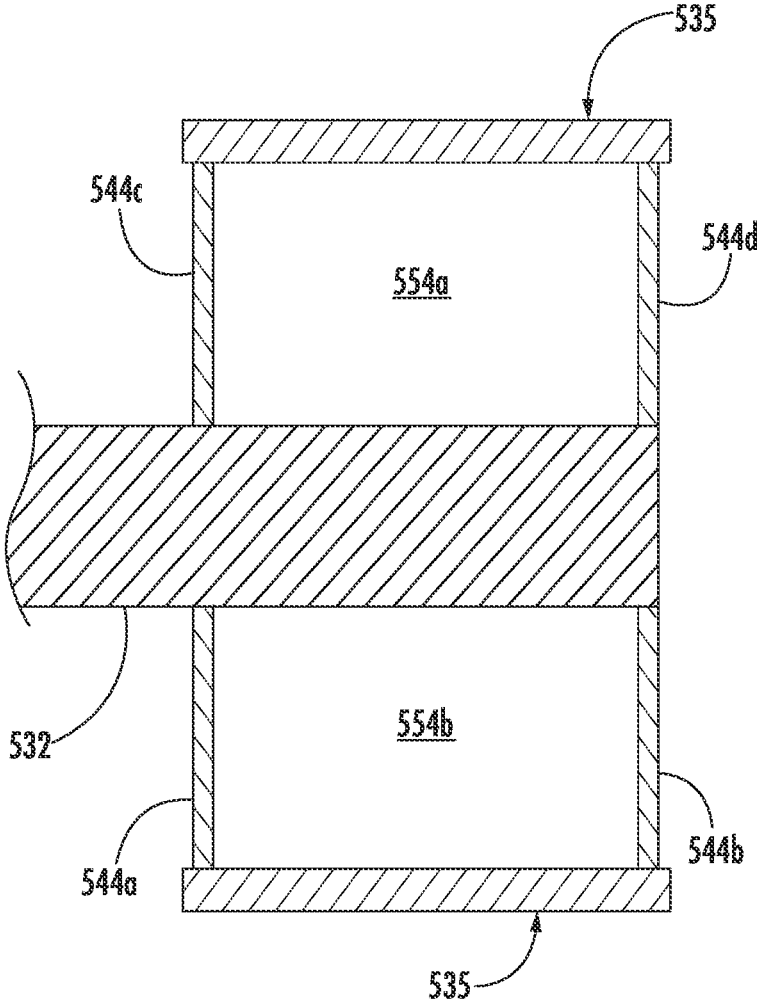
FIG. 22 is a schematic cross-sectional view of the proximal molding section from the fourth embodiment of the door assembly of FIG. 14 along line 22-22.

As perhaps best seen in FIG. 22, the proximal molding section 537 illustratively includes first and second proximal molding sweep strips 544*a*-544*b* on an outer surface of the sliding door 532, and third and fourth proximal molding sweep strips 544*c*-544*d* on an inner surface of the sliding door 532. When the sliding door 532 is closed, the proximal molding section 537 cooperates with the medial member 535 to define a second pair of conduits 554*a*-554*b* (FIG. 22). As perhaps best seen in FIGS. 18-19, the sliding door 532 illustratively includes door sweeps 545*a*-545*b* carried on a bottom edge to define a longitudinal channel fluidly coupled to the first conduit and the second conduit when the sliding door 532 is in the closed position, thereby preventing frost build-up on the threshold of the sliding door.

The door assembly 530 illustratively comprises a first positive pressure source 546*a* fluidly coupled to the proximal molding section 537 when the door 532 is in the closed position, and a second positive pressure source 546*b* fluidly coupled to the distal molding section when the door is in the closed position. The door assembly 530 comprises first and second heaters 547*a*-547*b* respectively adjacent the first and second positive pressure sources 546*a*-546*b*. Each of the proximal molding section 537 and the distal molding section 540 defines a vertical channel for passage of heated air when the door 532 is in the closed position.

Figure 19:
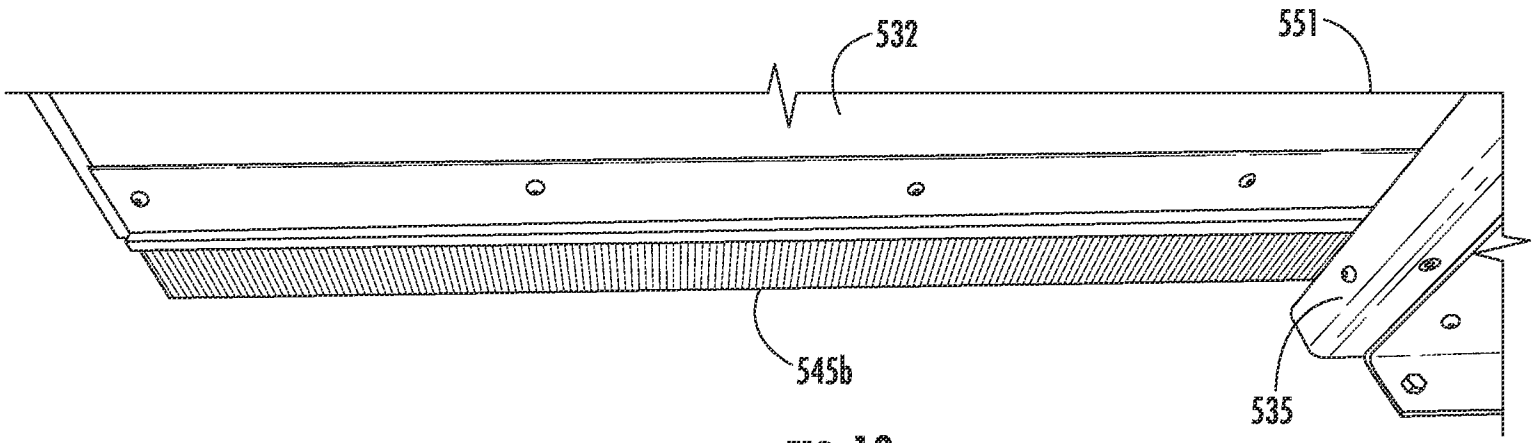
FIG. 19 is a schematic perspective view of a door sweep from the fourth embodiment of the door assembly of FIG. 14.
Figure 20:
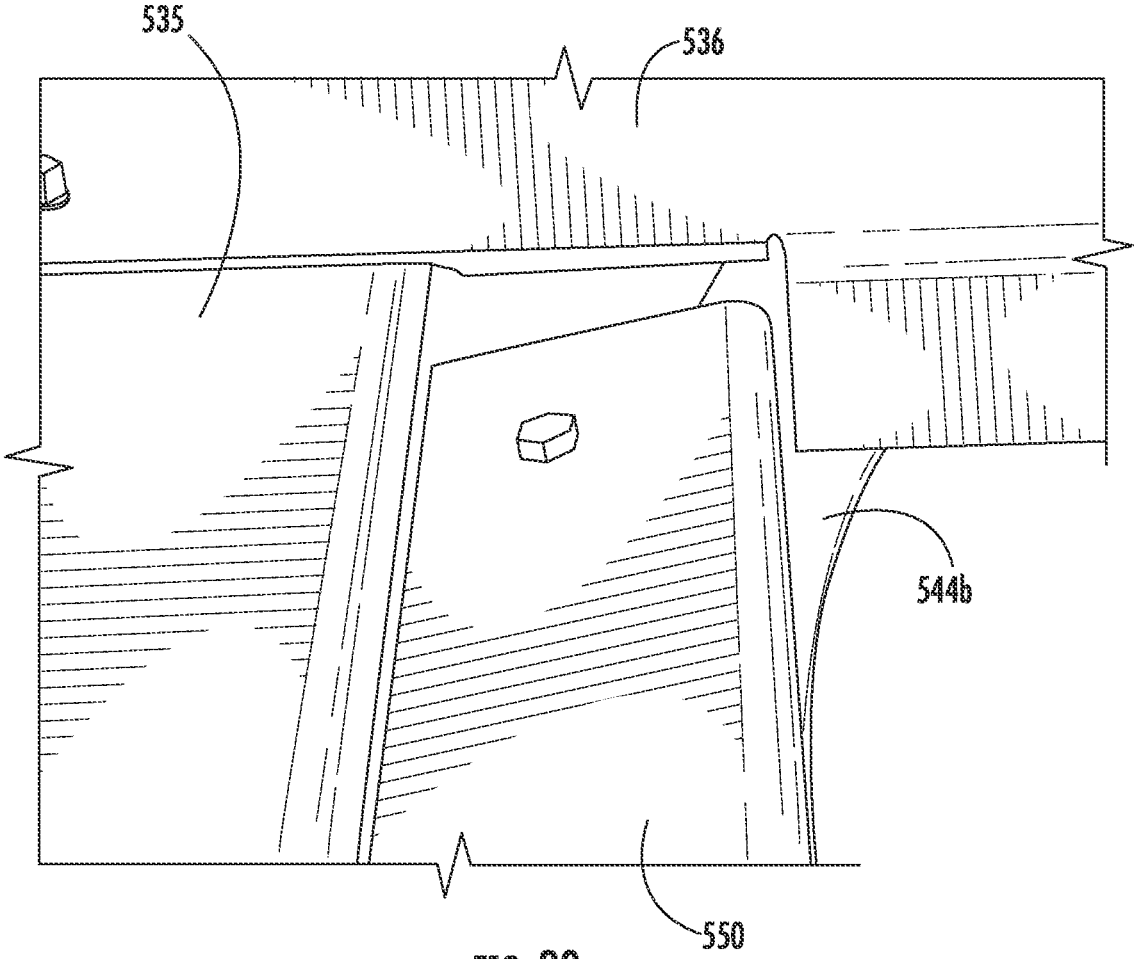
FIG. 20 is a schematic side view of a guide from the fourth embodiment of the door assembly of FIG. 14.

As perhaps best seen in FIG. 20, the sliding door 532 illustratively includes a longitudinal guide 550 coupled to the medial member 535 and for engaging a proximal edge of the sliding door. The longitudinal guide 550 extends vertically between the top member 536 and the floor. The longitudinal guide 550 is angled away from the proximal molding section 537 to avoid ware thereon from repeated opening and closing of the sliding door 532. In some embodiments, the proximal molding section 537 may comprise first and second proximal molding sweep strips 544*a*-544*b* with magnetic devices therein for coupling to the sliding door 532 as it passes through. Also, as shown in FIG. 19, the door frame 531 illustratively includes a sweep 551 carried by the medial member 535 and to engage the sliding door 532 and remove frost from an outer surface of the sliding door.

Figure 21:
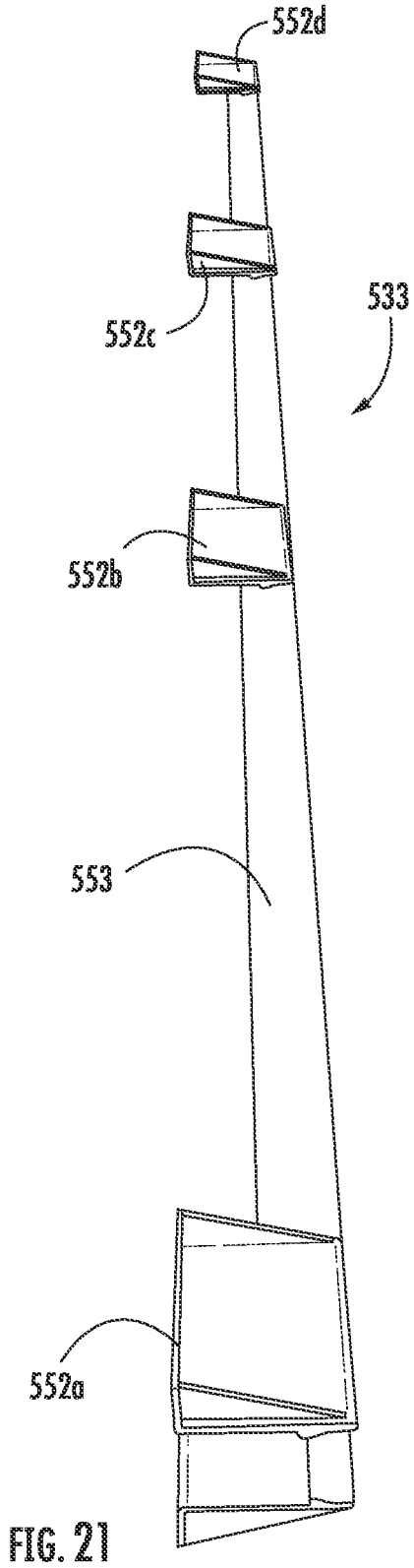
FIG. 21 is a schematic perspective view of an upper track from the fourth embodiment of the door assembly of FIG. 14.

As perhaps best seen in FIG. 21, the upper track 533 illustratively includes a plurality of arm pairs 552*a*-552*d*, and a channel body 553 coupled to the plurality of arm pairs and defining a longitudinal channel for slidingly receiving the sliding door 532. It should be appreciated, the sliding door 532 comprises a plurality of sliding devices (e.g. wheels, ball bearings) at an uppermost end and to be positioned in the longitudinal channel.

It should be appreciated that the features of each of the door assemblies 100, 230, 330, 430, 530 may be combined in multiple fashions.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A refrigeration door system with a defrosting feature, the refrigeration door system comprising:

a housing defining a refrigerated cavity therein; and a door assembly carried by the housing and providing access to the refrigerated cavity;

the door assembly comprising a door frame and a sliding door coupled to the door frame, the sliding door switching between an open position providing the access to the refrigerated cavity and a closed position where the refrigerated cavity is inaccessible, the door frame comprising a top member having a first end and a second end opposite the first end, a first side member coupled transversely to the first end of the top member and having a side conduit therein, a second side member coupled transversely to the second end of the top member, and a medial member coupled transversely to the top member between the first end and the second end of the top member, the medial member having a medial conduit therein, a first heated pressure source coupled to the top member and configured to output heated air into the side conduit, a second heated pressure source coupled to the top member and configured to output heated air into the medial conduit, and a proximal molding section adjacent a proximal end of the sliding door and cooperating with the medial member to define the medial conduit when the sliding door is in the closed position, the proximal molding section comprising first and second proximal molding strips adjacent an outer surface of the sliding door.

2. The refrigeration door system of claim 1 wherein the door assembly further comprises a distal molding section carried by the first side member.

3. The refrigeration door system of claim 2 wherein when the sliding door is in the closed position, the proximal molding section is aligned with the medial member, and the distal molding section is aligned with a distal edge of the sliding door.

4. The refrigeration door system of claim 1 wherein the door assembly further comprises an upper molding section carried by the top member.

5. The refrigeration door system of claim 1 wherein the sliding door comprises first and second door sweeps carried on a bottom edge of the sliding door to define a longitudinal channel fluidly coupled to the side conduit and the medial conduit when the sliding door is in the closed position.

6. The refrigeration door system of claim 1 wherein the door assembly further comprises a longitudinal guide coupled to the medial member and for engaging a proximal edge of the sliding door, the longitudinal guide extending vertically between the top member and a floor.

7. The refrigeration door system of claim 1 wherein the door assembly further comprises an upper track coupled to the top member and for slidingly carrying the sliding door.

8. The refrigeration door system of claim 1 wherein each of the first heated pressure source and the second heated pressure source comprises an elongate resistive heating device, and a fan adjacent to the elongate resistive heating device.

9. A door assembly for a refrigeration door system with a defrosting feature, the door assembly comprising:

a door frame;

a sliding door coupled to the door frame, the sliding door switching between an open position providing access to a refrigerated cavity and a closed position where the refrigerated cavity is inaccessible;

the door frame comprising a top member having a first end and a second end opposite the first end, a first side member coupled transversely to the first end of the top member and having a side conduit therein, a second side member coupled transversely to the second end of the top member, and a medial member coupled transversely to the top member between the first end and the second end of the top member, the medial member having a medial conduit therein;

a first heated pressure source coupled to the top member and configured to output heated air into the side conduit;

a second heated pressure source coupled to the top member and configured to output heated air into the medial conduit; and a proximal molding section adjacent a proximal end of the sliding door and cooperating with the medial member to define the medial conduit when the sliding door is in the closed position;

the proximal molding section comprising first and second proximal molding strips adjacent an outer surface of the sliding door.

10. The door assembly of claim 9 further comprising a distal molding section carried by the first side member.

11. The door assembly of claim 10 wherein when the sliding door is in the closed position, the proximal molding section is aligned with the medial member, and the distal molding section is aligned with a distal edge of the sliding door.

12. The door assembly of claim 9 wherein the door assembly further comprises an upper molding section carried by the top member.

13. The door assembly of claim 9 wherein the sliding door comprises first and second door sweeps carried on a bottom edge of the sliding door to define a longitudinal channel fluidly coupled to the side conduit and the medial conduit when the sliding door is in the closed position.

14. The door assembly of claim 9 further comprising a longitudinal guide coupled to the medial member and for engaging a proximal edge of the sliding door, the longitudinal guide extending vertically between the top member and a floor.

15. The door assembly of claim 9 further comprising an upper track coupled to the top member and for slidingly carrying the sliding door.

16. A method for making a refrigeration door system with a defrosting feature, the method comprising:

coupling a door assembly to be carried by a housing and providing access to a refrigerated cavity, the door assembly comprising a door frame and a sliding door coupled to the door frame, the sliding door switching between an open position providing the access to the refrigerated cavity and a closed position where the refrigerated cavity is inaccessible, the door frame comprising a top member having a first end and a second end opposite the first end, a first side member coupled transversely to the first end of the top member and having a side conduit therein, a second side member coupled transversely to the second end of the top member, and a medial member coupled transversely to the top member between the first end and the second end of the top member, the medial member having a medial conduit therein;

positioning a first heated pressure source coupled to the top member and configured to output heated air into the side conduit; and positioning a second heated pressure source coupled to the top member and configured to output heated air into the medial conduit;

the door assembly comprising a proximal molding section adjacent a proximal end of the sliding door and cooperating with the medial member to define the medial conduit when the sliding door is in the closed position;

the proximal molding section comprising first and second proximal molding strips adjacent an outer surface of the sliding door.

17. The method of claim 16 wherein the door assembly further comprises a distal molding section carried by the first side member.

18. The method of claim 17 wherein when the sliding door is in the closed position, the proximal molding section is aligned with the medial member, and the distal molding section is aligned with a distal edge of the sliding door.

19. The method of claim 16 wherein the door assembly further comprises an upper molding section carried by the top member.

20. The method of claim 16 further comprising coupling first and second door sweeps carried on a bottom edge of the sliding door to define a longitudinal channel fluidly coupled to the side conduit and the medial conduit when the sliding door is in the closed position.

* * * * *